US008223061B2

(12) United States Patent
Bannasch et al.

(10) Patent No.: US 8,223,061 B2
(45) Date of Patent: Jul. 17, 2012

(54) METHOD AND APPARATUS FOR SPOOFING OF INFRARED, RADAR AND DUAL-MODE GUIDED MISSILES

(75) Inventors: Heinz Bannasch, Schönau (DE); Martin Fegg, Schönau (DE)

(73) Assignee: Rheinmetall Waffe Munition GmbH, Neuenburg/Baden (DE)

( * ) Notice: Subject to any disclaimer, the term of this patent is extended or adjusted under 35 U.S.C. 154(b) by 629 days.

(21) Appl. No.: 11/988,824

(22) PCT Filed: Jun. 28, 2006

(86) PCT No.: PCT/EP2006/006223

§ 371 (c)(1),
(2), (4) Date: Jan. 15, 2008

(87) PCT Pub. No.: WO2007/012371

PCT Pub. Date: Feb. 1, 2007

(65) Prior Publication Data

US 2009/0251353 A1 Oct. 8, 2009

(30) Foreign Application Priority Data

Jul. 25, 2005 (DE) ..... 10 2005 035 251

(51) Int. Cl.

| | |
|---|---|
| ***F41J 2/00*** | (2006.01) |
| ***F41J 2/02*** | (2006.01) |
| ***G01S 7/38*** | (2006.01) |
| ***F42B 5/15*** | (2006.01) |
| ***F42B 12/70*** | (2006.01) |
| *F42B 5/00* | (2006.01) |
| *F42B 12/00* | (2006.01) |

(52) U.S. Cl. ..... 342/14; 342/5; 342/7; 342/9; 342/12; 342/13; 89/1.11; 102/501

(58) Field of Classification Search ..... 244/1 R, 244/1 TD, 3.1–3.3; 455/1; 89/1.8, 1.815, 89/1.816, 1.11, 1.41; 342/1–20; 102/335, 102/336, 342, 357, 501, 504, 505

See application file for complete search history.

(56) References Cited

U.S. PATENT DOCUMENTS 3,068,472 A * 12/1962 Dell Aria ..... 342/13
3,150,848 A * 9/1964 Lager ..... 244/3.16

(Continued)

FOREIGN PATENT DOCUMENTS

AU 4332285 12/1985

(Continued)

*Primary Examiner* — Bernarr Gregory
(74) *Attorney, Agent, or Firm* — Lucas & Mercanti, LLP; Klaus P. Stoffel

(57) ABSTRACT

The invention proposes to provide distraction spoofing even on modern infrared, radar and dual-mode guided missiles (4) by production of a decoy chain (20). The chain (20) is formed by a plurality of apparent targets which are switched successively, for example by firing of individual chaff submunitions (2.1-2.5). The deployment takes place before or during the search phase of the missile and can in this case, for example, be carried out using the reverse walk-off principle or at the same time simultaneously or successively and in the form of a pattern. This ensures that the decoys (2.1-2.5) act initially in the greatest selected range zone away from the target (3). The spoofing chain (20) created in this way results in the missile (4) having to carry out a series of time-consuming analysis processes on its way to the target (3).

9 Claims, 1 Drawing Sheet

U.S. PATENT DOCUMENTS

| | | | | | |
|---|---|---|---|---|---|
| 3,339,201 | A | * | 8/1967 | Fischer et al. | 342/14 |
| 4,149,166 | A | * | 4/1979 | Null | 342/13 |
| 4,222,306 | A | | 9/1980 | Maury | |
| 4,233,605 | A | * | 11/1980 | Coleman | 342/6 |
| 4,307,665 | A | * | 12/1981 | Block et al. | 342/12 |
| 4,549,489 | A | | 10/1985 | Billard et al. | |
| 4,808,999 | A | * | 2/1989 | Toman | 342/15 |
| 4,852,455 | A | * | 8/1989 | Brum | 244/1 TD |
| 5,249,527 | A | * | 10/1993 | Schwind | 89/1.11 |
| 5,333,814 | A | * | 8/1994 | Wallis | 244/1 TD |
| 5,359,918 | A | * | 11/1994 | Meili et al. | 89/1.816 |
| 5,400,690 | A | * | 3/1995 | Meili et al. | 89/1.816 |
| 5,452,640 | A | * | 9/1995 | Bovee et al. | 89/1.815 |
| 5,497,156 | A | * | 3/1996 | Bushman | 342/9 |
| 5,786,786 | A | * | 7/1998 | Small | 342/13 |
| 5,814,754 | A | * | 9/1998 | Mangolds | 89/1.11 |
| 5,835,051 | A | | 11/1998 | Bannasch et al. | |
| 5,852,254 | A | * | 12/1998 | Wardecki | 89/1.11 |
| 6,324,955 | B1 | * | 12/2001 | Andersson et al. | 89/1.11 |
| 6,384,765 | B1 | * | 5/2002 | Sjostrand et al. | 342/15 |
| 6,513,438 | B1 | | 2/2003 | Fegg et al. | |
| 6,542,109 | B2 | * | 4/2003 | Lloyd et al. | 342/14 |
| 6,662,700 | B2 | * | 12/2003 | O'Neill | 89/1.11 |
| 6,804,495 | B2 | * | 10/2004 | Duthie | 244/3.1 |
| 7,028,947 | B2 | * | 4/2006 | Burns | 244/1 TD |
| 2002/0145554 | A1 | * | 10/2002 | Lloyd et al. | 342/13 |
| 2003/0205126 | A1 | * | 11/2003 | O'Neill | 89/1.11 |
| 2006/0249009 | A1 | * | 11/2006 | Rubin | 89/1.11 |

FOREIGN PATENT DOCUMENTS

| | | | |
|---|---|---|---|
| BE | 457723 | | 11/1944 |
| DE | 342 1734 | | 12/1985 |
| DE | 196 01 165 | | 7/1997 |
| DE | 196 17 701 | | 11/1997 |
| DE | 199 51 767 | | 5/2001 |
| DE | 100 16 781 | | 10/2001 |
| DE | 101 02 599 | | 8/2002 |
| DE | 102 30 939 | | 2/2004 |
| EP | 0708305 | | 4/1996 |
| EP | 1026473 | | 8/2000 |
| GB | 2138546 | A * | 10/1984 |
| GB | 2309070 | | 7/1997 |

* cited by examiner

METHOD AND APPARATUS FOR SPOOFING OF INFRARED, RADAR AND DUAL-MODE GUIDED MISSILES

This is a U.S. National Stage of application No. PCT/EP2006/006223, filed on Jun. 28, 2006. Priority is claimed on that application and on the following application:

Country: Germany, Application No.: 10 2005 035 251 Filed: Jul. 25, 2005.

BACKGROUND OF THE INVENTION

Infrared-guided, radar-guided, and dual-mode guided missiles are deployed, for example, to attack maritime targets, such as ships, or other objects on land or in the air. After they have been launched, these missiles or rockets are initially guided into the target area by an inertial sensor system (e.g., German published application DE 196 01 165 A1, published on Jul. 17, 1997, which corresponds to British Patent Application GB 2 309 070) or by GPS. The missile enters a search phase after it has come within a suitably short distance of the target. It then locks onto the target and tracks it until impact (track phase). A track gate depth D is about 150 m in older missiles but only a few meters in modern missiles.

To spoof guided missiles of this type, different types of decoys are used to protect objects by hindering the missile by interference with its function. When a threat has been detected, some decoys emit electromagnetic decoy signals (German published application DE 100 16 781 C2, published Oct. 25, 2001), while others form "clouds" of floating dipoles (chaff clouds), which are tuned to the radar frequency of the missile.

Variants of these floating dipoles include, for example, (radar) confusion decoys, (radar) seduction decoys and (radar) distraction decoys. A confusion decoy is deployed at a great distance between the object to be protected (ship) and the attacker, generally as a preventive measure before the missile is launched. When a large number of these decoys is deployed, the enemy's search is confused, because decoy targets are produced alongside the actual target object. A seduction (deflection) decoy is deployed during a missile attack after the missile has locked onto the target. In order to deflect the missile, these decoys have, for example, a higher radar reflection cross section than the object itself. These decoys are activated within a track gate with the aim of producing their effect there. Distraction decoys, on the other hand, are activated in an early stage of a missile attack, in any event, before lock-on. The distance from the object must be greater than the track gate of the missile. This guarantees that the missile, on its track to the object, initially acquires the decoy that is offered to it as the target.

German published application DE 196 17 701 A1, published on Nov. 11, 1997, which corresponds to U.S. Pat. No. 5,835,051 discloses a method for producing a false target. With this method, infrared-guided, radar-guided and dual-mode guided missiles are guided away from the actual target to a phantom target. By using a specific ratio of dipole mass to flare mass, the dipoles are swirled by the combustion of the flares. The masses are fired in submunitions in such a way that by adjustment of the delay times, the disintegration and ejection process occurs at a distance of about 10 to 60 m from the launcher, so that the effective masses act within the reduced range gates of the target-seeking heads. A decoy of this type is disclosed in German published application DE 199 51 767 C2, published on May 10, 2001, which corresponds to U.S. Pat. No. 6,513,438.

German published application DE 102 30 939 A1, published on Feb. 12, 2004, discloses a method and a device for protecting fighting vehicles from threatening weapons which use the electromagnetic spectrum from the ultraviolet range, through the visible range and the infrared range, to the radar range for target recognition and/or target acquisition and/or weapon guidance.

German published application DE 101 02 599 A1, published on Aug. 14, 2002, discloses chaff with a broadband effect over the entire radar frequency range of 0.1 to 1,000 GHz, which consists of conductive or nonconductive fibers with a conductive coating. Other IR-reflecting and/or radar-reflecting masses, etc., are given in the prior-art document German published application DE 102 30 939 A1 published on Feb. 12, 2004.

However, modern guided missiles are capable of distinguishing chaff clouds or the like from true targets. This is generally accomplished by means of various sufficiently well-known methods, for example, by polarization and fluctuation analyses. Therefore, the effectiveness of decoys, especially distraction decoys, is no longer guaranteed in these cases.

SUMMARY OF THE INVENTION

The objective of the invention is thus to specify a method and a device for spoofing guided missiles, with which even modern infrared-guided missiles, radar-guided missiles, and dual-mode guided missiles can be successfully distracted.

The invention is based on the idea of realizing distraction spoofing even of modern infrared-guided, radar-guided, and dual-mode guided missiles by producing a decoy chain. The chain is formed by a plurality of successively actuated false targets, for example, by firing individual chaff submunitions. The deployment takes place before or during the search phase of the missile and can be carried out, for example, by using the reverse walk-off principle or simultaneously or successively and in the form of a pattern. In the process, it is ensured that the decoys with the greatest selected range zone from the target act first. The effect of the decoy chain created in this way is that the missile must carry out a series of time-consuming analyses on its way to the target, with each false analysis typically taking about 2 to 4 seconds to complete. As a result of this measure, the method for guiding enemy target-seeking heads to false targets is already optimized in the search phase before lock-on occurs.

The effectiveness of the chain is critically determined by its correct formation, which is defined by the parameters of direction of deployment, distance at which the effect occurs, number of decoys, time at which the effect unfolds, and/or radar reflection cross section. The reaction or analysis time of the missile is increased especially by the number of decoys. Therefore, the number of decoys should be as large as possible; in practice, a sufficiently large number of decoys has been found to be five.

The device for carrying out this method can be realized with decoy systems or launchers that are already known. In this regard, however, in contrast to these previously known systems, for example, all of the submunitions are filled 100% with chaff or the like.

The invention is explained in greater detail below with reference to the specific embodiment of the invention illustrated in the drawings.

DETAILED DESCRIPTION OF THE INVENTION

Figure 1:
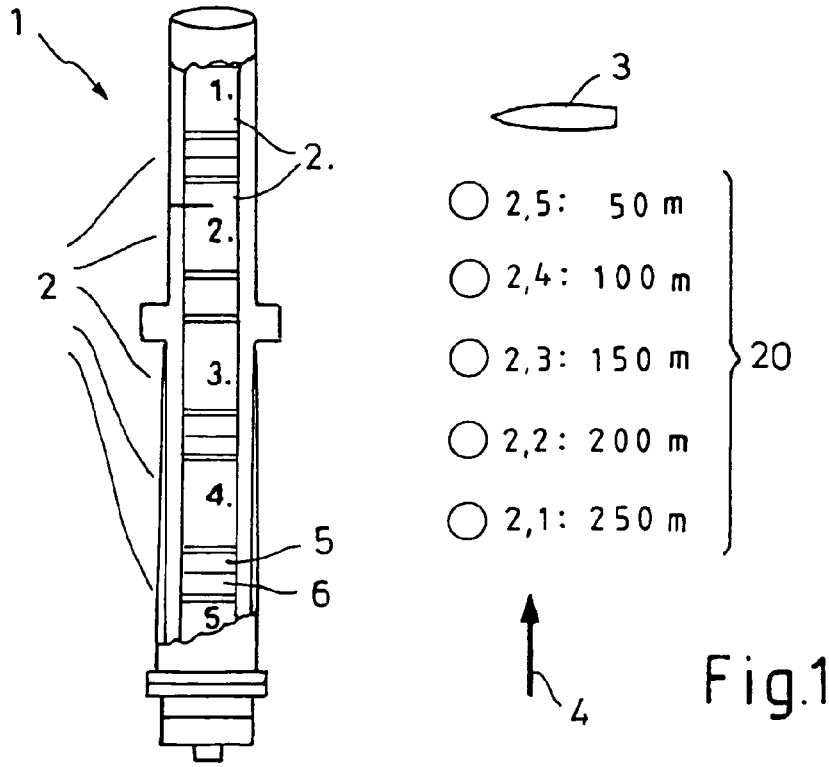
FIG. 1 shows a distraction munition with radar submunitions.
Figure 2:
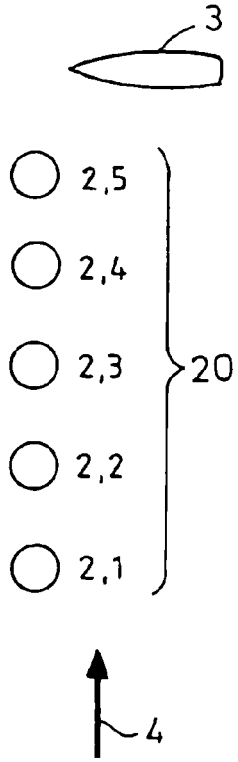
FIG. 2 shows the method for protecting an object.

FIG. 1 shows a distraction munition 1, in this case with several radar submunitions 2 (2.1 to 2.5), which is used to protect an object 3, which is also shown in FIG. 2, against, for example, a radar-guided missile 4. The radar submunitions 2 are filled 100% with chaff. In the specific embodiment illustrated here, the munition 1 contains 5 submunitions/decoys 2.1 to 2.5 (since five decoys 2.1 to 2.5 are sufficient for most scenarios), which form a decoy chain 20 or different false targets.

As has already been noted, the direction of deployment is also important for the effectiveness of a decoy chain 20 formed in this way. It is provided that the decoy chain 20 be deployed by the munition 1 in the direction of the missile 4 (line of sight) or in the opposite direction after the search phase of the missile 4. If the search process of the missile 4 is not known, simultaneous deployment in both directions is advisable. To prevent two (false) targets from being simultaneously present in the track gate of the missile 4, a minimum distance D of the (false) targets from the object 3 (ship) and from one another must be maintained.

The time at which the effect of the individual decoys 2.1 to 2.5 unfolds is governed by the fact that the decoys 2.1 to 2.5 of the decoy chain 20 should be activated at an early time. It is preferred that the decoys 2.1 to 2.5 be deployed as a preventive measure while the missile 4 is still in the search phase.

The radar reflection cross section of the individual decoys 2.1 to 2.5 can be kept relatively small, i.e., significantly smaller than the radar reflection cross section of the object 3; it is only necessary that it be above the lock-on threshold of the missile 4. A reflection cross section of about 500 $m^2$ is generally sufficient.

The decoy chain 20 can be integrated in a decoy system of a type that is already known, in this case, in a 130-mm munition 1. Predetermined or desired range staggering for the different analysis times can be realized by suitable combinations of propellant charge 5 and timing element 6 (not shown in detail). In the preferred embodiment illustrated here, the range staggering of the five decoys 2 is set at 250 m for 2.1, 200 m for 2.2, 150 m for 2.3, 100 m for 2.4, and 50 m for 2.5. After the munition 1 has been fired, the decoys 2.1-2.5 are released; they can be released at the same time or staggered in time. In this regard, however, the decoy 2.1 preferably, but not necessarily, produces its effect first at about 250 m, the decoy 2.2 produces its effect second at 200 m and so on, with the effect of decoy 2.5 unfolding last at about 50 m, i.e., the decoys are sequentially activated.

The invention claimed is:

1. A method for protecting an object from infrared-guided, radar-guided, and dual-mode guided missiles by way of submunitions, which, as decoys, form a decoy chain, and are deployed by a munition, the method comprising the step of deploying the decoys of the decoy chain in a manner so that effects of the decoys occur at respective predeterminable distances from the object and counteract the missile at different ranges from the object.

2. The method in accordance with claim 1, including simultaneously deploying the decoys.

3. The method in accordance with claim 1, including deploying the decoys staggered in time.

4. The method in accordance with claim 1, including defining effectiveness of the decoy chain by parameters of direction of deployment, distance at which the effect occurs, number of decoys, time at which the effect occurs, or radar reflection cross section.

5. The method in accordance with claim 1, including deploying the decoys of the decoy chain in the direction of the missile or in an opposite direction before or during a search phase of the missile.

6. The method in accordance with claim 1, including programming range staggering of the decoys in the munition.

7. The method in accordance with claim 6, wherein a minimum range staggering between the decoys is 20 m.

8. The method in accordance with claim 1, wherein a radar reflection cross section of the individual decoys is greater than a lock-on threshold of the missile.

9. A device for protecting an object from radar-guided missiles, comprising decoys, which are deployed by a munition, wherein several decoys form a decoy chain, each decoy including a propellant charge and a timing element effective to actuate the decoy at a preset distance from the object and thus from the missile, the preset distance being different for each decoy in the decoy chain.

* * * * *